United States Patent [19]

Bohm

[11] 4,330,330

[45] May 18, 1982

[54] WORK MATERIAL OF SILVER WITH TIN AND TUNGSTEN OXIDES FOR ELECTRICAL CONTACT

[75] Inventor: Wolfgang Bohm, Alzenau, Fed. Rep. of Germany

[73] Assignee: Degussa AG, Frankfurt, Fed. Rep. of Germany

[21] Appl. No.: 174,827

[22] Filed: Aug. 4, 1980

[30] Foreign Application Priority Data

Aug. 17, 1979 [DE] Fed. Rep. of Germany ..... 2933338

[51] Int. Cl.[3] ..... C22C 5/06

[52] U.S. Cl. ..... 148/430; 75/234; 200/266

[58] Field of Search ..... 75/173 A, 233, 234; 200/266

[56] References Cited

U.S. PATENT DOCUMENTS 2,486,341 10/1949 Stumbock ..... 75/173 A
3,933,486 1/1976 Shibata ..... 75/173 A

FOREIGN PATENT DOCUMENTS 2428147 11/1974 Fed. Rep. of Germany .
2754335 12/1977 Fed. Rep. of Germany .
1001017 8/1965 United Kingdom ..... 75/234

*Primary Examiner*—L. Dewayne Rutledge
*Assistant Examiner*—David A. Hey
*Attorney, Agent, or Firm*—Cushman, Darby & Cushman

[57] ABSTRACT

There are needed materials based on $Ag/SnO_2$ to replace the known Ag/CdO materials for electrical contact on switches, which replacement materials contain an additional metal oxide component, without having to take into account an undesired temperature increase in the switching device. This is attained according to the invention with a material that contains 8–20 weight % tin oxide $SnO_2$, 0.05–5 weight % tungsten oxide, balance silver.

8 Claims, No Drawings

WORK MATERIAL OF SILVER WITH TIN AND TUNGSTEN OXIDES FOR ELECTRICAL CONTACT

BACKGROUND OF THE INVENTION

The invention is directed to a material for electrical contacts or switches made of silver, tin oxide ($SnO_2$) and a further metal oxide and process for producing it.

For the production of electrical contacts or switches there has previously proven best for a large number of uses Ag/CdO. Because CdO pollutes the environment, however, there have been intensified searches to replace CdO by another metal oxide. In these investigations it has been found that $SnO_2$ is a suitable replacement for CdO. Because of the higher thermal stability of $SnO_2$ compared to CdO there results a clearly reduced rate of consumption which leads to a longer life. However, a very substantial disadvantage of Ag/$SnO_2$ is that the contact resistance at the switch after several thousand switchings is too high through formation of a coating layer. As a rule this leads then to increased temperatures in the switching device, which can lead to the destruction of the device and therefore are inadmissible.

A further disadvantage of this Ag/$SnO_2$ material compared to Ag/CdO is the lower safety against welding. The forces which are required to tear apart the welding bridge are in part twice as high as with Ag/CdO switches. Therewith there are the changes of switching disturbances with insertion of Ag/$SnO_2$.

Therefore have been attempts to increase the welding safety by the addition of further metal oxides to Ag/$SnO_2$ in which case there are used, for example, bismuth oxide (German O.S. No. 2754335) or indium oxide (Gemeran O.S. No. 2428147). Indeed these additives improve the welding safety but are accompanied, however, by an increased temperature at the contact and at the switching device which impairs the life of the device.

SUMMARY OF THE INVENTION

This problem was solved according to the invention by employing a material containing 8–20 weight % tin oxide, 0.05–5 weight % tungsten oxide, balance silver. With this material there surprisingly occurs a great reduction of the excess temperature, so that the same, or in part even lower temperatures are found in the switching device as with Ag/CdO. Also, the welding strengths of Ag/$SnO_2$ surprisingly can be substantially reduced by the addition of tungsten oxide.

There has especially proven satisfactory a material which consists of 10–15 weight % tin oxide, 0.2–1.5 weight % tungsten oxide, balance silver. Astonishingly even with a very small tungsten oxide content there is a clear improvement in regard to the excess temperature. There are obtained especially good results if the $SnO_2$ is introduced homogeneously without agglomerates and having a primary particle size below 5 microns.

This fine distribution of the metal oxide components can be attained by wet sieving the $SnO_2$ before the mixing, or especially advantageously through mixing and kneading the silver, tin oxide and tungsten oxide powder in the wet condition. Through the wet sieving secondary agglomerates of the $SnO_2$ are removed before the mixing. In the process with mixing and kneading in the wet condition the secondary agglomerate are destroyed through the high shearing forces which occurred and therewith there is produced a uniform and finely divided distribution of the components.

It is immaterial for the switching behavior whether tin oxide and tungsten oxide are reacted previously through heat treatment to a mixed oxide or are present locally present in the switching material.

The substantial improvement in switching behavior which is attained with the material of the invention compared to Ag/CdO and Ag/$SnO_2$ is made clear in the following table in connection with the examples. For this purpose there was used a switching device 3TB54 of the Siemens Company.

The materials of the invention were produced by powder metallurgy after wet kneading with subsequent extruders.

Unless otherwise indicated all parts and percentages are by weight.

The composition can consist essentially of or consist of the stated materials.

DETAILED DESCRIPTION OF THE INVENTION

TABLE

| Material | Life (number of switchings) | Welding Strength (99.5% of all values are lower) | Temperature after over 30,000 switchings (°C.) |
|---|---|---|---|
| Ag/CdO 88/12 powder metallurgy | about 50,000 | 120–200 | 70–80 |
| Ag/CdO 90/10 internally oxidized | about 50,000 | 180–250 | 70–80 |
| Ag/$SnO_2$ 85/15 powder metallurgy | about 140,000 | 250–350 | 110–140 |
| Ag/$SnO_2$ 88/12 powder metallurgy | about 140,000 | 250–350 | 110–140 |
| Ag/$SnO_2$/$WO_3$ 88/11.7/0.3 | about 140,000 | 150–220 | 70–80 |
| Ag/$SnO_2$/$WO_3$ 88/11.5/0.5 | about 140,000 | 150–220 | 70–80 |

What is claimed is:

1. A material suitable for use in electrical switches consisting essentially of 8–20 weight % tin oxide, 0.05–5 weight % tungsten oxide, balance silver.

2. A material according to claim 1 which consists essentially of 8–20 weight % tin oxide, 0.5–5 weight % tungsten oxide, balance silver.

3. A material according to claim 1 which consists essentially of 10–15 weight % tin oxide, 0.2–1.5 weight % tungsten oxide, balance silver.

4. A material according to claim 3 which consists essentially of 11.5–11.7 weight % tin oxide, 0.3–0.5 weight % tungsten oxide, balance silver.

5. An electrical switch made of the material of claim 4.

6. An electrical switch made of the material of claim 3.

7. An electrical switch made of the material of claim 2.

8. An electrical switch made of the material of claim 1.

* * * * *